United States Patent [19]

Parise

[11] 4,288,885

[45] Sep. 15, 1981

[54] HOT WATER VACUUM EXTRACTION MACHINE WITH REVERSE FAN COOLED VACUUM MOTOR

[75] Inventor: Carl Parise, Sparks, Nev.

[73] Assignee: Parise & Sons, Inc., Sparks, Nev.

[21] Appl. No.: 134,732

[22] Filed: Mar. 27, 1980

[51] Int. Cl.[3] ..... A47L 7/00

[52] U.S. Cl. ..... 15/321; 15/413

[58] Field of Search ..... 15/321, 353, 413

[56] References Cited

U.S. PATENT DOCUMENTS

| | | | |
|---|---|---|---|
| 3,821,830 | 7/1974 | Sundheim | 15/321 |
| 3,831,223 | 8/1974 | Colt et al. | 15/321 |
| 3,848,290 | 11/1974 | Bates | 15/321 |
| 3,896,521 | 7/1975 | Parise | 15/321 |
| 4,019,218 | 4/1977 | Cyphert | 15/321 |
| 4,068,340 | 1/1978 | Forward | 15/321 |

*Primary Examiner*—Chris K. Moore

*Attorney, Agent, or Firm*—Sughrue, Mion, Zinn, Macpeak and Seas

[57] ABSTRACT

A vacuum pump assembly, axially mounted within a hot water vacuum extraction machine enclosed housing, includes an enclosed cylindrical casing. A vertical axis shaft mounted fan at the lower end of the vacuum pump assembly casing rotates within an annular shroud bearing radial ports and which closely surrounds the fan blading with minimal air gap between the tips of the fan blades and the shroud annular sidewall to improve cooling air flow through the fan and over the pump assembly motor coils and reducing the hot water vacuum extraction machine housing interior temperature and that within the vacuum pump assembly. By cooling air flow discharge from the bottom of the extraction machine housing, water entry to the vacuum pump assembly interior is prevented.

4 Claims, 5 Drawing Figures

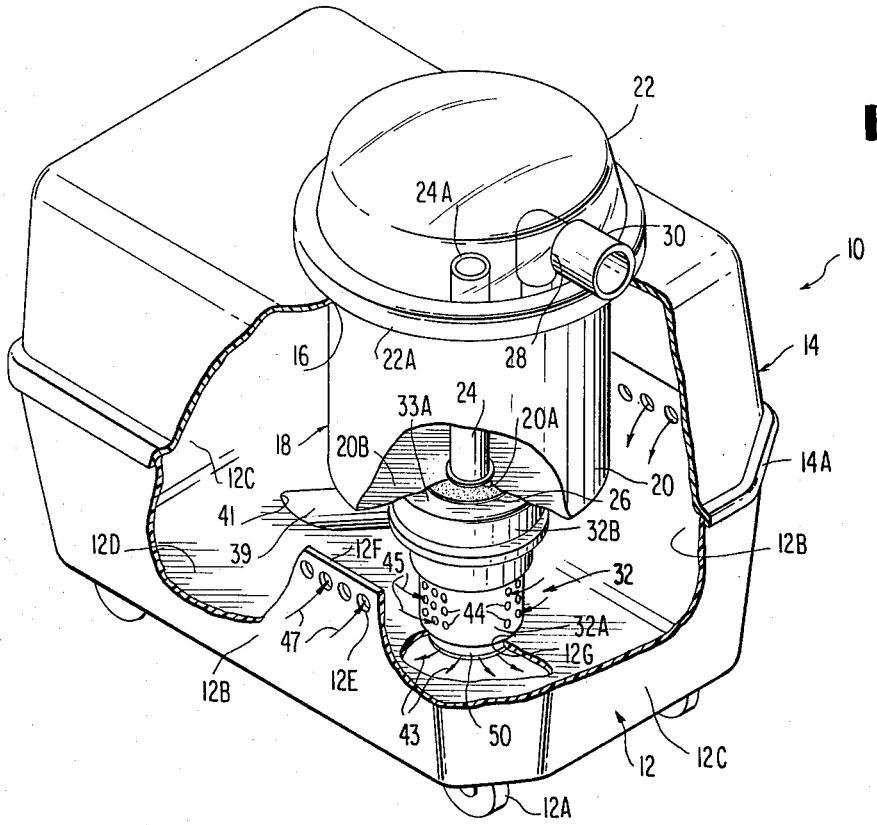
FIG. 1
FIG. 2
PRIOR ART
FIG. 3
PRIOR ART
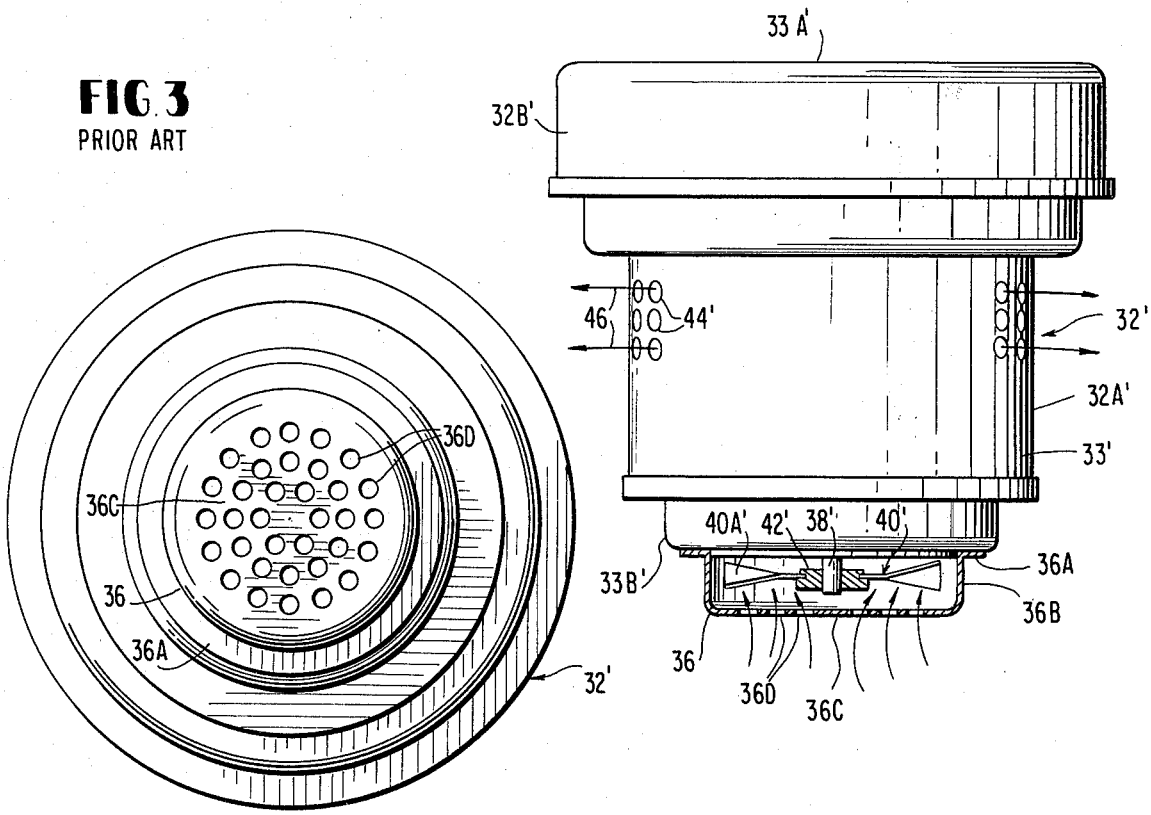

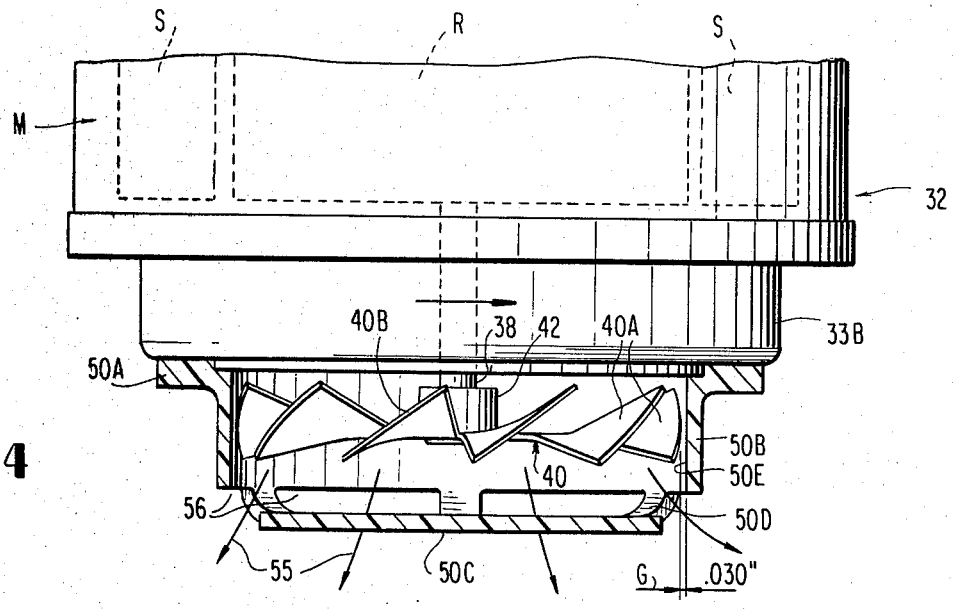
FIG. 4
FIG. 5
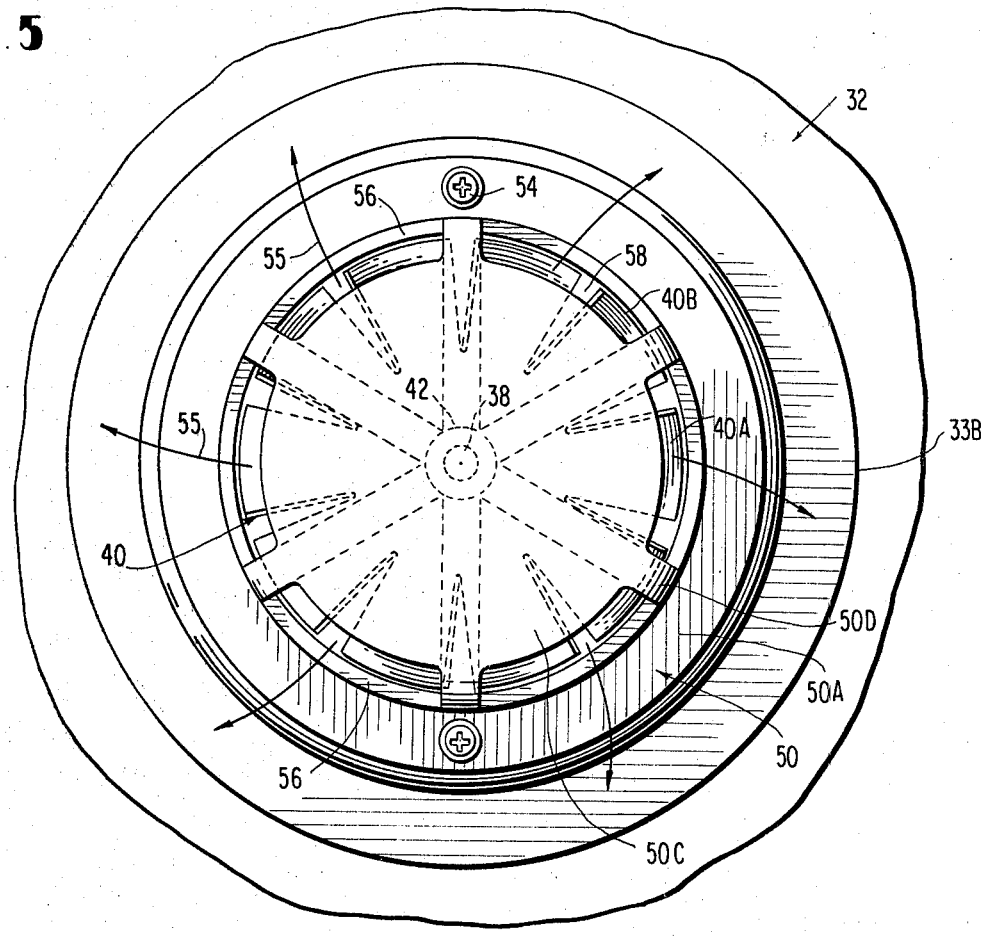

HOT WATER VACUUM EXTRACTION MACHINE WITH REVERSE FAN COOLED VACUUM MOTOR

FIELD OF THE INVENTION

This invention relates to hot water vacuum extraction machines, and more particularly, to an improved vacuum pump assembly which operates at lower temperature, with improved cooling of the motor windings and without danger of water entering the vacuum pump interior.

BACKGROUND OF THE INVENTION

Hot water vacuum extraction machines, or as sometimes mis-named "steam cleaners," have come into vogue for home use as a result of commercial exploitation of applicant's patented concepts exemplified by applicant's U.S. Pat. Nos. 3,896,521 and 3,911,524. In the machine illustrated and described in U.S. Pat. No. 4,122,579, the steam cleaner employs a dump bucket, and in addition a soap tank, both elements being mounted within the upper half of a two part molded housing functioning as an enclosure for the internal components of the vacuum machine. Water and detergent are placed normally in the soap tank and an immersion heater within that tank heats the detergent containing water to an elevated temperature. Additionally, an internal water pump draws the detergent containing water from an outlet at the soap tank and forces it through a flexible tube or hose to an atomizer nozzle on a wand supported head, whereby a stream of hot detergent containing water issues from the nozzle in mist form, sometimes inaccurately referred to as "steam." The machine is normally employed in the wet cleaning of rugs with the detergent containing water and entrained dirt from the rug picked up by a vacuum head mounted to the end of the wand and returned to the machine carried dump bucket. This is achieved by use of an internal vacuum pump which communicates with the interior of the dump bucket via a hollow riser tube, creating a vacuum pressure within the interior of the dump bucket and external air rushing through the vacuum wand draws the detergent containing water and the entrained dirt into the interior of the dump bucket 12 where it accumulates. The air is separated from the water and entrained dirt within the dump bucket interior, the air passing through the riser tube by way of the induced suction due to vacuum pump operation with the air discharging through an air discharge pipe leading from the vacuum pump assembly casing and through the bottom of the lower half of the steam cleaner housing.

Necessarily, in order to prevent the electric motor driving the vacuum pump within the vacuum pump assembly casing from burning out or overheating, there is a requirement to cool the motor windings. This has been accomplished in the past by mounting the vacuum pump assembly such that its lower end projects through or is flush with an opening of similar diameter formed within the bottom wall of the steam cleaner housing lower half. Further, the lower end of the cylindrical vacuum pump assembly casing bears openings permitting air to be sucked up from beneath the machine and forced over the motor windings by means of a fan fixed to the lower end of the motor shaft and rotatable therewith. The motor rotates in a direction such that the air is sucked into the interior of the vacuum pump assembly casing through its lower end and the cooling air is forcibly discharged through a series of perforations or openings within the cylindrical sidewall of the vacuum pump assembly casing. The air enters the interior of the machine housing, and passes exteriorly of the unit through openings within the side of either the upper or lower housing halves.

While the vacuum pump assembly provides some cooling to the motor windings and maintains the interior of the steam cleaner housing to an acceptable low temperature, there is a tendency, particularly where the unit operates on surfaces bearing an accumulation of water, for water to be drawn into the air inlet at the lower end of the vacuum pump assembly casing, resulting in damage to the motor winding and, under some circumstances, the rendering of the vacuum pump inoperable. Further, while the temperature to which the components of the steam cleaner were subjected is reduced by the cooling air flow within the housing itself as well as the cylindrical casing of the vacuum pump assembly, the electric motor has not operated at its most efficient temperature. Further, over time, there exists the possibility of deterioration of the components interior of the housing due to the relatively high temperature experienced by those components.

It is, therefore, a primary object of the present invention to provide an improved water vacuum extraction machine in which the electric drive motor for the vacuum pump, as well as all of the components within the interior of the machine housing, operate at substantially reduced temperature from prior known machines, and wherein the effectiveness of air flow through the motor is appreciably increased, thereby eliminating hot spots.

It is a further object of the present invention to provide an improved hot water vacuum extraction machine having a highly effective air cooling arrangement for a sealed, cylindrical vacuum pump assembly, and in which positive air flow functions during machine operation to effectively prevent water from entering the area of the motor winding of the vacuum pump.

It is a further object of the present invention to provide an improved reverse flow fan for a vacuum pump assembly employable within a hot water vacuum extraction machine, in which the cooling efficiency of the motor is enhanced, and wherein air turbulence in the area of the fan blading is reduced to reduce the recirculation of exhaust air and wherein smooth exiting of the exhaust air is accomplished with minimum back pressure.

SUMMARY OF THE INVENTION

The present invention is directed to an improved hot water vacuum extraction machine and to a vacuum pump assembly incorporated therein. The hot water vacuum extraction machine comprises an enclosed housing having a dump bucket assembly vertically mounted within the housing including an upright open ended dump bucket bearing an inverted cup-shape cover which is sealingly fitted to the top of the bucket. A vacuum wand connectable hose coupling projects within the dump bucket assembly interior to return, by vacuum application to the interior of the bucket assembly, water and entrained dirt during surface cleaning. About an opening provided within the bottom of the dump bucket, there is mounted a vertical riser tube which is open at its top interiorly of the dump bucket. The enclosed extraction machine housing fixedly mounts an electric motor driven vacuum pump assembly beneath the dump bucket. The pump assembly includes an enclosed cylindrical casing having opposed end walls and a cylindrical sidewall. The upper end wall of the pump casing bears a vacuum intake opening which is sealably aligned with the opening in the bottom of the dump bucket leading to the riser tube. The vacuum pump includes a vertical axis electric motor driving the vacuum pump within the upper part of the vacuum pump casing. An air discharge pipe extends exteriorly from the vacuum pump casing and opens at its opposite end, within the bottom wall of the machine housing, to the housing exterior. A fan is mounted to the motor rotor shaft and rotates therewith. Openings are provided within the lower end wall of the casing and the sidewall of the cylindrical vacuum pump assembly casing; whereby, fan induced air flow in passing over the motor windings interior of the vacuum pump assembly casing cools the windings.

The improvement resides in use of an annular cylindrical shroud which closely surrounds the fan blades to provide a minimal gap between the tips of the blades and the shroud cylinder sidewall, with the direction of the motor fan blade rotation being such that the air is drawn into the casing interior through the holes within the sidewall and exits axially through the minimal size gap between the fan blade tips and the shroud cylinder sidewall; whereby, the small gap in the tips of the fan blades and the shroud cylindrical sidewall reduces air turbulence and eliminates heat production in the area of air flow through the shroud due to recirculation of exhaust air. Further, the downward movement of the forced air discharged from the vacuum pump assembly casing forces any water underlying the casing to move away from the cooling air discharge area, thereby preventing water from entering into the area of the motor windings. Preferably, the annular shroud comprises an imperforate horizontal end wall and a plurality of generally circumferentially spaced radial ports are provided within the cylindrical sidewall of the annular shroud at the periphery of the imperforate end wall to effect the smooth exit flow of the exhaust air with minimum back pressure.

BRIEF DESCRIPTION OF THE DRAWINGS

FIG. 1 is a perspective view, partially broken away of a hot water vacuum extraction machine employing the improved low turbulence, reverse fan high efficiency air cooled vacuum pump assembly of the present invention.

FIG. 2 is a vertical elevational view, partially in section, of a prior art vacuum pump assembly as employed in a hot water vacuum extraction machine.

FIG. 3 is a bottom plan view of the prior art vacuum pump assembly illustrated in FIG. 2.

FIG. 4 is an enlarged, elevational view, partially in section of the improved vacuum pump assembly employed in the hot water vacuum extraction machine of FIG. 1.

FIG. 5 is a bottom plan view of the portion of the improved vacuum pump assembly illustrated in FIG. 4.

DESCRIPTION OF THE PREFERRED EMBODIMENT

Referring to the drawings, FIG. 1 shows a hot water vacuum extraction machine or steam cleaner, indicated generally at 10, which employs as a major element thereof, a vacuum pump assembly incorporating the improved air cooling means of the present invention, while FIGS. 2 and 3 show a prior art vacuum pump assembly bearing a standard cooling arrangement.

It should be kept in mind that applicant's improvement in this art resides in the replacement of the vacuum pump assembly shown in FIGS. 2 and 3 with the vacuum pump assembly bearing improved air cooling features, as evidenced in FIGS. 1, 4 and 5.

The hot water vacuum extraction machine as illustrated in FIG. 1 may employ the vacuum pump assembly of FIGS. 2 and 3 of the prior art design, as well as applicant's improved vacuum pump assembly, as shown in detail in FIGS. 4 and 5.

Therefore, the hot water vacuum extraction machine or steam cleaner, indicated generally at 10 in FIG. 1, comprises a two part housing including an upwardly open, lower housing half indicated at 12 and being supported by way of castors or wheels 12B such that the unit may be movable about an underlying floor surface (not shown). The housing lower half 12 is formed integrally with laterally opposed sidewalls 12B and longitudinally opposed end walls 12C and a bottom wall 12D, the sidewalls 12B bearing a plurality of small circular apertures or openings 12E to permit cooling air to pass therethrough as required. The housing upper half indicated generally at 14 is essentially a mirror image of the housing lower half 12 with the exception that it bears an outwardly projecting rim 14A, such that the rim 14A rests on top of an upper edge 12F of the housing lower half 12. The hot water vacuum extraction machine 10 may incorporate a soap tank (not shown), as discussed previously. It is purposely not shown, so as to simplify the description of the invention. Since, however, the invention resides in an improved air flow cooling system or structural arrangement for the electric drive motor incorporated within the vacuum pump assembly, the dump bucket assembly and its components are illustrated with the dump bucket operatively connected to the upper end of a vacuum pump assembly. In this respect, the housing upper half 14 is provided with a relatively large circular hole 16 within which rests a dump bucket assembly indicated generally at 18, and comprised of an upwardly open, dump bucket 20, upon which is sealably mounted a downwardly open inverted cup-shaped cover 22. The cover 22 is preferably translucent or transparent such that the interior of the dump bucket may be viewed. The cover 22 includes an integral, radially outwardly projecting flange or lip 22A which sealably rests on the upper edge of the dump bucket 20. The dump bucket 20 is provided with a central circular opening 20A of given diameter within its bottom wall 20B, and sealably and mechanically mounts a cylindrical riser tube 24 whose upper end 24A is open and which terminates short of the cover 22. A disc-type seal 26 functions to sealably mount the riser tube 24 to the bottom wall 20B of the dump bucket 20. Further, the cover 22 is provided with an opening 28 within the sidewall of the member through which projects a return coupling indicated at 30 which of L-shaped configuration and which is connected by way of a flexible hose or the like (not shown) to a vacuum wand (not shown) such that by vacuum pressure application to the interior of the dump bucket 20, water bearing entrained dirt vacuum removed from the surface being cleaned may be returned to the interior of the dump bucket assembly 18. The return flow discharges from the return coupling 30 interiorly of the dump bucket 20 and water and entrained dirt accumulate within the bottom of the dump bucket 20, rising to a level short of cover 22. At that time in the cleaning process, the machine is shut down, the cover 22 is removed, the dump bucket 20 is lifted from the housing, the dirty water and entrained dirt are removed from the dump bucket 20 allowing it to be replaced, thereby permitting further operation of the hot water vacuum extraction machine.

As mentioned previously, such hot water vacuum extraction machines or steam cleaners require a vacuum pump to set up the vacuum pressure within the dump bucket assembly 18, which is capable of sucking into that bucket, by vacuum pressure application, water and entrained dirt from the surface being cleaned. Here, air is separated from the water, with the air by vacuum application to riser tube 24 rushing downwardly within that riser tube 24 to an underlying vacuum pump fixedly positioned within the housing lower half 12 and whose intake is sealably connected with the riser tube 24.

In that respect, both the prior art type vacuum pump assembly generally indicated at 32' in FIGS. 2 and 3, and the improved vacuum pump assembly indicated at 32 in FIGS. 1, 4 and 5 may be identically mounted with housing half 12 and may be of the same general size and configuration. Purposely, in FIG. 1, the means for fixedly mounting vacuum pump assembly 32 is not shown so that the air cooling aspects of ths assembly may be fully illustrated as well as the nature of the cooling flow path for the air passing through the vacuum pump casing and its movement both within and exterior of the steam cleaner housing.

In both the improved vacuum pump assembly of the present invention and that of the prior art, the vacuum pump assembly comprises two principal components: a vacuum pump which is located vertically above an underlying electric drive motor for the same and directly beneath the dump bucket. In order to appreciate the distinctions between the prior art and the present invention, reference to FIGS. 2 and 3 show vacuum pump assembly 32' as comprised of an upper vacuum pump section 32B' and a lower electric pump drive motor section 32A', and while both sections may include separate casings, it is assumed that there is a single cylindrical casing 33' having opposed end walls. Thus, for FIGS. 2 and 3, cylindrical casing 33' is provided with an upper end wall 33A' and a lower end wall 33B' which may in fact take the form of an end bell bearing a cylindrical opening within the center thereof. A cover 36, which is formed of sheet metal such as steel, is comprised of an annular cylindrical wall 36B, bears radially outwardly projecting integral flange 36A at one end permitting it to be fixedly mounted to the end bell 33B' while the cover 36 is provided with an end wall 36C which is perforated or apertured at 36D. For purposes of understanding the nature of the cooling air flow, it is required that the vacuum pump assembly 32' of FIGS. 2 and 3 be envisioned as being incorporated within the hot water vacuum extraction machine of FIG. 1 for the vacuum pump assembly 32 shown therein, in which case the cover 36 projects within a hole 12G formed within the bottom wall 12D of that housing lower half 12 and further, that the perforations 36D of the cover end wall 36C face the underlying floor or support surface upon which the machine rests with the end wall 36C being spaced slightly from that surface. As a matter of fact, the housing lower half 12 may be of vacuum formed plastic or the like with the perforated end wall 36C of the vacuum pump assembly casing cover 36 several inches above the surface being cleaned. Additionally, the cylindrical sidewall 33' of the vacuum pump casing bears a plurality of small diameter apertures or holes 44' at circumferentially spaced positions about its periphery functioning as cooling air passages for air flow, in this case exiting from the casing as evidenced by arrows 46, the air flow being induced to enter the perforations 36D of the cover 36 upon rotation of radial fan blades 40A of a fan indicated generally at 40, which blades are fixedly mounted to the projecting end of a vertical rotor shaft 38' by way of hub 42'. The pump drive motor rotor rotates in such a direction with respect to the pitch of the blades 40A' that air flow is induced by way of suction to enter the cover 36 from the bottom of the machine and to move over motor coils (not shown) interiorly of the cylindrical side wall 33' of the casing prior to exiting through holes or openings 44' in the direction of arrows 46. In turn, with the hot water vacuum extraction machine housing lower half 12C bearing openings 12E within opposite sides thereof, the cooling air which leaves the casing sidewall 33 of the vacuum pump assembly first passes into the interior of the housing and then exits through the openings 12F, thereby discharging the heat from the motor windings to the room within which the unit is employed which is at some lower ambient temperature.

As may be appreciated, where the cover 36 and the perforated end wall 36C thereof open directly to the underlying surface being cleaned and which may be in the neighborhood of one and one-half inches above that surface, a hazard exists even where the water on that surface does not rise to the level of the intake openings 36D. Under certain circumstances, the machine may find itself in one to two inches of water, and this is disastrous, as water is readily sucked up and blown over the motor windings or coils internally of cylindrical casing 33.

Turning next to FIGS, 1, 4 and 5, which show applicant's invention as an improvement, it must be appreciated that the vacuum pump assembly indicated generally 32 and particularly the vacuum pump section 32B lies directly beneath the dump tank 20 and that upper casing end wall 33A of that assembly bears a circular opening within the center of the same alignable with and in sealable fluid communication with riser tube 24 of the dump bucket 20. Normally, there is a short pipe of a smaller diameter than that of riser tube 24 connected to the pump assembly and which extends internally of riser tube 24 and which constitutes an attachment or extension of end wall 33A. Thus, riser tube 24 functions as an inlet to the vacuum pump itself, the vacuum pump being driven by an electric motor indicated generally at M, FIG. 4, and located below the vacuum pump section 32B and within the electric drive motor section 32A of this assembly. In conventional fashion in FIG. 1, there is shown a vacuum pump air discharge tube 39 which extends from the pump assembly cylindrical casing 33 through housing half 12 interior and opening at one end to the exterior of the housing lower half 12 by way of an aperture 41 within the bottom wall 12D of that housing. The vacuum pump air discharge tube 39 is quite remote from the area of discharge for the cooling air which exits beneath the housing lower half 12', by way of annular fan shroud indicated generally at 50 which projects through opening 12G at the bottom wall 12D of that housing lower half.

Within the casing sidewall 33, there are provided a series of holes 44. In fact, this portion of the pump assembly casing may be identical to that of casing sidewall 33' of the prior art of the pump assembly shown in FIG.

2. However, in this case, the cooling air is shown as entering the holes or openings as evidenced by arrows 45, the cooling air first entering the housing sidewall holes 12E as indicated by arrows 47 to flow through the interior of the housing lower half 12. Upon entering the interior of the cylindrical casing 33 housing the motor coils or stator windings S which surround the motor rotor R, as indicated in dotted lines in FIG. 4, the air flows downwardly and exits through a circular axial opening within end bell 33B mounted to the lower end of the cylindrical side wall 33 of the vacuum pump assembly 32.

Motor M includes a vertical axis shaft 38. The shaft 38, supported by bearings (not shown) within end bell 33B, bears rotor R which is concentrically mounted within the casing 33 and interiorly of laterally oppositely positioned stator windings S. The air is drawn downwardly through the axial opening within end bell 33B into specially constructed and configured annular shroud 50 which is fixedly mounted to end bell 33B. In that respect, the annular fan shroud 50 is of cast or molded nylon material and includes an integral cylindrical sidewall 50B bearing at its upper end radially outwardly directed flange 50A. A plurality of screws 54 pass through the flange 50A and mechanically mounting the fan shroud 50 to end bell 33B. Integrally formed with the fan shroud cylindrical sidewall 50B is an imperforate axial end wall 50C, the shroud sidewall 50B bearing a plurality of circumferentially spaced, elongated slots 56 at the peripheral edge of end wall 50C. The end wall 50C is joined to the sidewall 50B of the fan shroud by means of integral bridging arms 50D.

In like manner to the prior art, the drive motor shaft 38 bears a hub 42 of slightly larger diameter and mounted to the hub 42 is the motor cooling fan indicated generally at 40, the fan 40 being formed preferably of a single sheet of light-weight metal such as aluminum, initially taking the form of a flat disc but bearing a plurality of slots 58 which extend radially inward from the outer periophery, forming individual blades indicated at 40A which are bent relative to the plane of the blade disc at its center to provide a desired pitch for the individual fan blades. Thus, the fan 40, when rotating horizontally about the vertical axis of shaft 38 causes air flow in a vertically downward direction, the air flow being extremely limited between the tips 40B of the fan blades 40A and the inside surface 50E of the cylindrical sidewall 50B of the fan shroud 50, with this gap at a minimum, as indicated at G, FIG. 4, and in the illustrated embodiment being 0.30 inches. Additionally, the openings 56 within the fan shroud are of correspondingly increased cumulative surface area compared to the perforations 36D borne by end wall 36C of the cover 36 of the prior art vacuum pump assembly of FIGS. 2 and 3 to readily exhaust the cooling air flow after passage over the stator windings S and to effect discharge generally radially of the fan shroud, adjacent fan shroud end wall 50C. The cooling efficiency is enhanced not only by reversing the air flow through the motor portion of the vacuum pump assembly, but the higher cooling efficiency is additionally achieved due to the fan shroud construction and the small gap G which exists between the tips 40B of the fan blades 40A and the shroud interior wall surface 50E. The small gap G acts to reduce air turbulence which produces heat in this area with attendent recirculation of the exhaust air rather than discharge as indicated by arrows 55, FIGS. 4 and 5.

Further, the slotted openings at the intersection of the shroud end wall 50C and its sidewall 50B provide smooth exit of the exhaust air with minimum back pressure. Tests have shown that in the illustrated embodiment of the invention, the presence of the small peripheral air gap G between the blades 40A and the shroud sidewall 50B improves performance by reduction of 15° F. in the motor temperature and that the presence of the end wall 50C of the shroud increases the interior temperature of the motor only 3° F. over an arrangement in which the axial lower end of the shroud 50 was completely open.

As may be appreciated, the inside temperature of the housing lower half 12 of the hot water vacuum extraction machine is maintained at a temperature which is only about 3° F. above the ambient temperature compared to a rather large temperature differential of approximately 30° F. of the prior art absent the improved air cooling arrangement of the present invention.

The improvement in cooling efficiency by way of the incorporation of the fan shroud, the reverse flow direction, the pitch and structural make up of the fan itself and the minimal gap G between the periphery or tip of the fan blades and the cylindrical sidewall of the fan shroud, is aptly demonstrated by certain tests. In conducting the tests, temperatures were ascertained by way of a pyrometer manufactured by A. P. I. Instruments Company of the type 1/C No. 447862 and thermocouples of the J type involving a 10 ohm resistor. The test method involved instrumenting the units with thermocouples which were turned on and stabilized. Temperature stabilization was considered to have been reached when the temperature rise was less than one degree F. for 15 minutes at each of the thermocouple locations. Thermocouples T1-T5 were placed at various locations on the stator coils. Thermocouples T6 were placed interiorly of the hot water vacuum extraction machine housing and thermocouple T7 measured the ambient temperature. Tests were made as follows:

TEST 1

3 gallon unit with 115937 vacuum motor in normal configuration (air being pushed into motor).

Thermocouples were attached to the drive end and the anti-drive end of the field coil, to the inside of the housing 12, in free air and to room temperature in free air.

| RESULTS | | |
|---|---|---|
| Field Coil A.D.E. | 150° F. | Δ T 64° F. |
| Field Coil D. E. | 180° F. | Δ T 99° F. |
| Inside housing | 115° F. | Δ T 29° F. |
| Ambient | 86° F. | |

TEST 2

Same as Test 1 except that fan was reversed to push air out of the bottom of the case and the fan shroud was modified.

| RESULTS | | |
|---|---|---|
| Field Coil A.D.E. | 140° F. | Δ T 58° F. |
| Field Coil D. E. | 172° F. | Δ T 90° F. |
| Inside housing | 85° F. | Δ T 3° F. |
| Ambient | 82° F. | |

SUBJECT: Temperature Test - Vacuum Motor and Housing

TEST 3

Same as above (Test 2) with vacuum formed bottom.

| RESULTS | | |
|---|---|---|
| Field Coil A.D.E. | 120° F. | Δ T 51° F. |
| Field Coil D. E. | 150° F. | Δ T 81° F. |
| Case Temperature | 72° F. | Δ T 3° F. |
| Ambient | 69° F. | |

TEST 4

RV-6 with 130 in motor normal configuration.

| RESULTS | | | |
|---|---|---|---|
| T1 | 135° F. | Δ T 64° F. | |
| T2 | 158° F. | Δ T 87° F. | Mean Temperature 63.25 |
| T3 | 145° F. | Δ T 74° F. | |
| T4 | 99° F. | Δ T 28° F. | |
| T5 | 100° F. | Δ T 29° F. | |
| T6 | 100° F. | Δ T 29° F. | |
| T7 | 71° F. | | |

TEST 5

Same as above (Test 4) with reverse air flow through motor and modified fan shroud.

| RESULTS | | | |
|---|---|---|---|
| T1 | 140° F. | Δ T 51° F. | |
| T2 | 150° F. | Δ T 61° F. | Mean Temperature 52.25 |
| T3 | 145° F. | Δ T 56° F. | |
| T4 | 130° F. | Δ T 41° F. | |
| T5 | 141° F. | Δ T 52° F. | |
| T6 | 91° F. | Δ T 2° F. | |
| T7 | 89° F. | | |

Subject: Temperature Test - Vacuum Motor and Housing

From the test results, it was seen that all temperatures were well within the limits set by Underwriters Laboratories and normal practices for such equipment when air is blown through the motor in a conventional manner. Secondly, reductions of more than ten percent were realized both in hot spot and overall temperatures due to reversal of air flow through the motor and by way of the improved actions resulting from flow characteristics provided by the fan shroud and blade arrangement as evidenced in FIGS. 4 and 5.

While the invention has been particularly shown and described with reference to a preferred embodiment thereof, it will be understood by those skilled in the art that various changes in form and details may be made therein without departing from the spirit and scope of the invention.

What is claimed is:

1. In a hot water vacuum extraction machine including:

an enclosed housing, a dump bucket assembly vertically mounted within said housing and including an upright open ended dump bucket and an inverted cup-shaped cover sealingly fitted at its periphery to the top of said dump bucket, a hose coupling projecting within said dump bucket assembly interior for returning by vacuum application to the interior of said dump bucket assembly, water and entrained dirt for separation from the air within said dump bucket, an opening within the bottom of said dump bucket, a riser tube sealably mounted to said dump bucket bottom and surrounding said opening and extending vertically within said dump bucket, an electric motor driven vacuum pump assembly mounted vertically within said housing beneath said dump bucket, said vacuum pump assembly including:

an enclosed cylindrical housing having opposed upper and lower end walls and a cylindrical sidewall, said upper end wall bearing a vacuum intake opening for sealable engagement with the bottom of said dump bucket riser tube, a vacuum pump air discharge pipe extending from said casing cylindrical sidewall, through the interior of said vacuum extraction machine housing and opening to the exterior thereof, cooling air flow ports within said housing, cooling air flow ports within said casing cylindrical sidewall intermediate of said ends, and cooling air passage means within the lower end wall of said vacuum pump assembly casing, an electric motor mounted within said casing including fixed motor coils and a rotor mounted via a rotor shaft for rotation about a vertical axis and bearing at one end of said shaft adjacent the lower end wall of said casing, a fan for causing forced air flow through the interior of said casing and over the motor coils within said casing, with said cooling air passing through said sidewall cooling air ports and said cooling air passage means of said lower end wall, respectively, the improvement wherein:

said vacuum pump assembly casing end wall comprises an annular shroud including a cylindrical shroud sidewall surrounding said fan, said fan mounted to said vertical axis shaft includes a plurality of fan blades which extend radially within said annular shroud and terminate just short of said shroud sidewall and form a minimal air gap therebetween with said shroud annular sidewall and said blades being of such pitch and the direction of rotation of said motor being such that air flow is forced downwardly through said cylindrical casing of said vacuum pump assembly, over said motor windings for discharge through the lower end of said shroud annular wall, with said cooling air required to enter said housing through said cooling air ports within said hot water vacuum extraction machine housing and through the openings within said cylindrical casing sidewall of said vacuum pump assembly prior to discharge from the bottom of said vacuum pump assembly casing, whereby, the cooling air is warmed and dried prior to entering the ports of said vacuum pump assembly cylindrical casing sidewall and in exiting causes a blowing effect to disperse any water underlying the lower end of said vacuum pump assembly casing, and wherein the minimal gap between the tips of the fan blades and the shroud cylindrical sidewall functions to reduce air turbulence with a subsequent reduction in the production of heat in this area due to recirculation of exhaust air.

2. The hot water vacuum extraction machine as claimed in claim 1, wherein said annular shroud further comprises an imperforate end wall underlying said fan, and said shroud further comprises a plurality of circumferentially spaced air discharge slots within said shroud sidewall in the area of intersection between the cylindrical sidewall of said shroud and said imperforate end wall, thereby providing a smooth exit for exhaust air from said casing with minimum back pressure.

3. An improved electric motor driven vacuum pump assembly for use in a hot water vacuum extraction machine, said hot water vacuum extraction machine including:

an enclosed housing, a dump bucket assembly vertically mounted within said housing and including an upright open ended dump bucket and an inverted cup-shaped cover sealingly fitted at its periphery to the top of said bucket, a hose coupling projecting within said dump bucket assembly interior for returning by vacuum application to the interior of said dump bucket assembly, water and entrained dirt for separation from the air within said dump bucket, an opening within the bottom of said dump bucket, a riser tube sealably mounted to said dump bucket bottom and surrounding said opening and extending vertically within said dump bucket, said electric motor driven vacuum pump assembly being mounted vertically within said housing beneath said dump bucket and said electric motor driven vacuum pump assembly including:

an enclosed cylindrical housing having opposed upper and lower end walls and a cylindrical sidewall, said upper end wall bearing a vacuum intake opening for sealable engagement with the bottom of said dump bucket riser tube, a vacuum pump air discharge pipe extending from said casing cylindrical sidewall, through the interior of said vacuum extraction machine housing and opening to the exterior thereof, cooling air flow ports within said vacuum extraction machine housing, cooling air flow ports within said casing cylindrical sidewall of its ends, and cooling air passage means within the lower end wall of said vacuum pump assembly casing, an electric motor mounted within said casing including fixed motor coils and a rotor mounted via a rotor shaft for rotation about a vertical axis and bearing at one end of said shaft adjacent the lower end wall of said casing, a fan for causing forced air flow through the interior of said casing and over the motor coils within said casing, with said cooling air passing through said sidewall cooling air ports and said cooling air passage means, the improvement wherein:

said vacuum pump assembly casing end wall comprises an annular shroud including a cylindrical shroud sidewall surrounding said fan, said fan mounted to said vertical axis shaft includes a plurality of fan blades which extend radially within said annular shroud and terminate just short of said shroud sidewall to form a minimal air gap therebetween, with said shroud annular sidewall and said blades being of such pitch and the direction of rotation of said motor being such that air flow is forced downwardly through said cylindrical casing of said vacuum assembly, over said motor windings for discharge through the lower end of said shroud annular wall, with said cooling air required to enter said housing through said cooling air ports within said hot water vacuum extraction machine housing and through the openings within said cylindrical casing sidewall of said vacuum pump assembly prior to discharge from the bottom of said vacuum pump assembly casing, whereby, the cooling air is warmed and dried prior to entering the ports of said vacuum pump assembly cylindrical casing sidewall and in exiting, causes a blowing effect to disperse any water underlying the lower end of said vacuum pump assembly casing, and wherein the minimial gap between the tips of the fan blades and the shroud cylindrical sidewall functions to reduce air turbulence with a subsequent reduction in the production of heat in this area due to recirculation of exhaust air.

4. The electric motor driven vacuum pump assembly as claimed in claim 3, wherein said annular shroud further comprises an imperforate end wall underlying said fan, said shroud further comprises a plurality of circumferentially spaced air discharge slots within said shroud sidewall in the area of intersection between the cylindrical sidewall of said shroud and said imperforate end wall thereby providing smooth exit for exhaust air from said with minimum back pressure.

* * * * *